US005456792A

United States Patent [19]

Rodriguez et al.

[11] Patent Number: 5,456,792

[45] Date of Patent: Oct. 10, 1995

[54] ADHESIVE DISPENSER

[75] Inventors: Peter A. Rodriguez, Atlantic Beach; Craig R. Austin, Jacksonville, both of Fla.

[73] Assignee: Sandar Industries, Inc., Jacksonville, Fla.

[21] Appl. No.: 394,192

[22] Filed: Feb. 24, 1995

Related U.S. Application Data

[63] Continuation of Ser. No. 152,749, Nov. 15, 1993.

[51] Int. Cl.[6] ..... B32B 31/00

[52] U.S. Cl. ..... 156/577; 156/523; 156/542; 156/579

[58] Field of Search ..... 156/523, 527, 156/542, 574, 577, 579, 584, 238

[56] References Cited

U.S. PATENT DOCUMENTS

| | | | |
|---|---|---|---|
| 3,902,956 | 9/1975 | Thompson, Jr. | 156/523 |
| 4,264,396 | 4/1981 | Stewart | 156/542 X |
| 4,295,916 | 10/1981 | Stevens | 156/495 X |
| 4,869,775 | 9/1989 | Quittner | 156/542 |
| 5,178,717 | 1/1993 | Rodriguez | 156/577 X |

*Primary Examiner*—James J. Engel
*Attorney, Agent, or Firm*—Arthur G. Yeager

[57] ABSTRACT

A device in a cassette container for applying a strip of double-sided adhesive to a surface which comprises a rotatable supply roll of a composite tape consisting of a strip of double-sided pressure-sensitive tape adhered to a backing layer strip, a transfer roller adapted to receive the composite tape, temporarily adhere to the tape and, after rotating through a portion of a turn, apply the adhesive strip to a receiving surface. A return bend surface is provided near the transfer roller for separating the backing layer from the adhesive strip adhering to the transfer roll; a channel leads the stripped backing layer away from the transfer roll, and a braking means selectively prevents rotation of the transfer roller and releases the roller for free rotation.

20 Claims, 2 Drawing Sheets

ADHESIVE DISPENSER

This is a continuation of application Ser. No. 08/152,749 filed on Nov. 15, 1993 now abandoned.

BACKGROUND OF THE INVENTION

In the paper industry a wide web of paper is produced and wound onto rolls at a high rate of speed (500–4000 feet per minute). Intermittently, it is necessary to transfer the web to a new roll without interrupting the travel of the web. This has been done by using a "turn up" tape such as that described in U.S. Pat. Nos. 2,461,246; 3,599,888; 3,765,615; 4,659,029; and 4,783,018. In my U.S. Pat. No. 4,659,029 there is a disclosure of a cutting tape made of a plurality of parallel strands of repulpable paper, and this tape has been found to be very useful in the above process for cutting the web and transferring the web to a new roll. Among the operations involved in the cutting and transferring is the application of pressure-sensitive adhesive to one side of the tape. My U.S. Pat. Nos. 4,783,018 and 5,046,675 disclose improvements in applying adhesive to such a cutting tape by the use of a double-sided pressure-sensitive tape. There are now further improvements in the method of applying adhesive by means of a double-sided pressure-sensitive tape.

It is an object of this invention to provide an improved device for applying adhesive to a cutting tape. It is another object of this invention to provide a replaceable cartridge or cassette that applies adhesive to a tape without the need for any complex driving or timing mechanism between the paper windup elements and the adhesive applicator. Still other objects will be apparent from the more detailed description which follows.

BRIEF SUMMARY OF THE INVENTION

This invention relates to a device substantially enclosed in a portable container for applying a strip of double-sided pressure-sensitive tape to a receiving surface, the device including a rotatable supply roll of composite tape consisting of a layer of double-sided pressure sensitive adhesive adhered to a strippable backing layer, a rotatable transfer roller having a cylindrical outer surface having poor affinity for adhering to the adhesive tape. A stationary tapering nose is provided with a tip having a return bend surface spaced apart from the surface of the transfer roller about the thickness of the double-sided tape. A first channel leads from the supply roll to the tip and a second channel leads from the tip to a disposal site for the backing layer. A brake member is included with a friction face spring biased to bear against the transfer roller and inhibit rotation thereof, and a selective means releases the brake member.

In specific and preferred embodiments of the invention the device may be stationary and apply adhesive to a moving tape, or the device may be moved to apply adhesive to a stationary surface. In either instance, the device requires no internal driving mechanism to operate it, and it preferably is self-contained with all of the components in a cartridge or cassette container, except for a portion of the transfer roller extending outwardly thereof.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features and operational advantages of this device are best understood by referring to the attached drawings.

Figure 1:
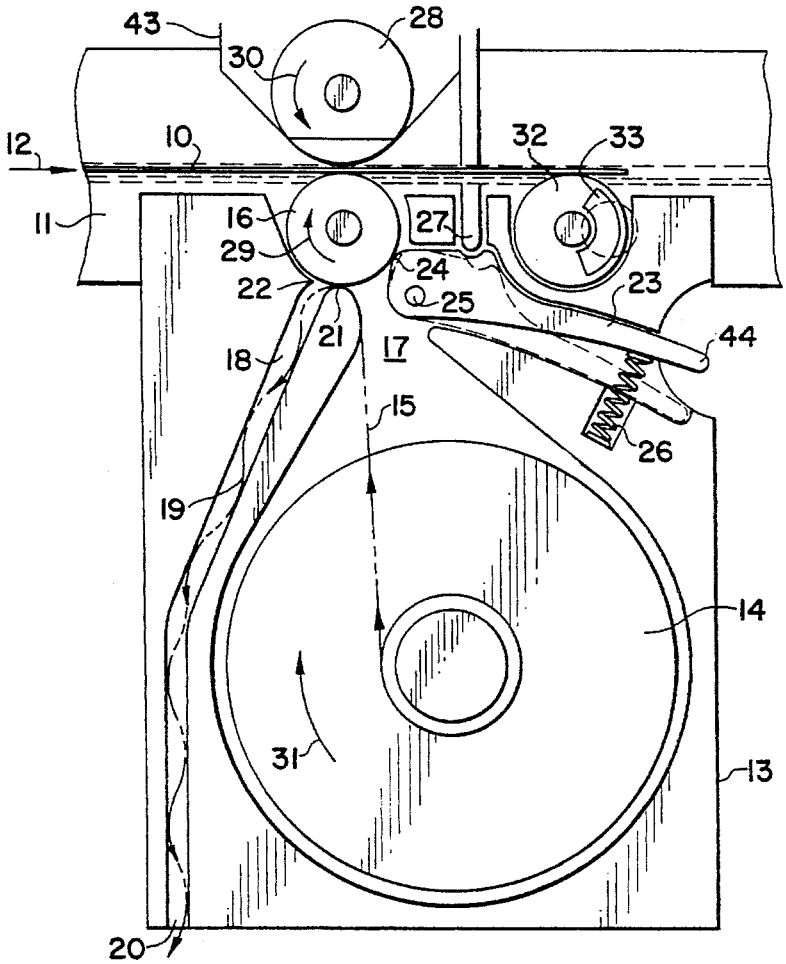
FIG. 1 is a front elevational view of the device of this inveniton as it might be employed to apply adhesive to a moving cutting tape.

In FIG. 1 there is shown a horizontal track 11 for guiding a cutting tape 10 from left to right in the direction of arrow 12. As the tape 10 passes by the device of this invention in a cartridge or cassette container 13 it applies a strip of adhesive to the bottom surface of tape 10 by contact with transfer roller 16. The adhesive is supplied from a composite tape 15 which includes a double-sided strip of pressure sensitive adhesive adhered to a layer of strippable backing tape 19. A supply roll 14 of the composite tape 15 feeds tape 15 to transfer roller 16 with contact between tape 15 and roller 16 being made at the tip 21 of a stationary nose built into the container 13. Nose tip 21 separates a first channel 17, leading from supply roll 14 to transfer roller 16, and a second channel 18 leading from transfer roller 16 to a disposal site for backing layer 19. Nose tip 21 is a sharp reverse bend so as to enhance the separation of backing layer 19 from the double-sided pressure-sensitive adhesive clinging to transfer roller 16. In order to assure this separation a doctor knife edge 22 is positioned closely adjacent to nose tip 21 and slightly downstream of it. Knife edge 22 is positioned very close to the surface of transfer roller 16 such that the adhesive layer on roller 16 will pass by knife edge 22 but the backing layer 19 will be deflected. Backing layer 19 is stripped away from the adhesive layer on transfer roller 16 and falls into second channel 18 where it eventually, by gravity and/or the force of backing layer 19 pushing on previously stripped backing layer 19, passes through exit port 20 to a waste receptacle or merely hangs downwardly until gathered by an operator for waste disposal. Backing layer 19 is normally a silicone treated paper having poor adherence to the pressure-sensitive adhesive, but may also be a plastic film such as a polyolefin, such as polyethylene or polypropylene, polyacetal, polyvinyl halide, polyvinyl ester, rubbers of various types, such as silicone rubber, etc. Transfer roller 16, likewise, is a material of poor affinity to the adhesive and preferably has a cylindrical surface of silicone rubber.

A brake mechanism is employed to stop the application of adhesive when desired. The brake mechanism shown here includes a pivotable brake lever 23 having a pivot point 25 and a friction face 24 to bear against transfer roller 16 so as to prevent it from rotating. The embodiments illustrated are based on a friction face 24, spring biased against applicator roll 16, but the braking action may be accomplished by engagement of teeth arranged as a rack and pinion. Spring 26 bears against arm 44 of brake lever 23 so as to bias friction face against roller 16. Thus, at rest, the brake mechanism is spring biased to prevent rotation and prevent application of adhesive to tape 10. In order for the device to operate brake lever 23 must be forced to release friction face 24 from contact with transfer roller 16. This is accomplished in FIG. 1 by the downward movement of plunger 27, which is not an element of this device, but rather is a part of the paper windup machine to which the device of this invention is attached. Plunger 27 moves up and down as member 43 moves up and down. Pressure roller 28 is also carried by member 43. Pressure roller 28 in its down position bears against the upper surface of cutting tape 10 directly opposed to transfer roller 16, and provides the force to transfer the strip of adhesive from transfer roller 16 to tape 10 by reason of the fact that the adhesive sticks much more firmly to tape 10 than it does to transfer roller 16. By enabling automatic controls the operator may cause the movement of member 43, which normally is up with no contact between pressure roller 28 and tape 10. When the machine is to prepare a length of tape 10 with adhesive thereon, member 43 automatically moves downwardly to apply the force of pressure roller 28 to tape 10 and to release the brake mechanism by pushing downwardly on brake lever arm 23 so as to disengage friction face 24 from transfer roller 16. The position of brake member 23 and friction face 24 at rest is shown in solid lines in FIG. 1, and when pushed downwardly by plunger 27 to release the brake, their positions are shown in dotted lines.

One step in the operation of using the cutting tape to cut a moving web of paper and to transfer the cut web to a new windup roll is to push the forward end of the cutting tape, with adhesive on its bottom surface, across the width of the moving web of paper and have the forward end near to the new windup roll. In order to be sure that the forward end of the tape has adhesive on it, an adhesive detector roll 32 is employed on the tape transfer machinery to which the device 13 of this invention is attached. Adhesive detector roll is positioned very close to the lower surface of tape 10 which moves by from left to right. Roll 32 has a surface which has a slight affinity to the pressure-sensitive adhesive and will, therefore, be moved by the contact with the adhesive Strip in tape 10. This will cause roll 32 to rotate which, in turn, is detected by rotation sensor 33. If roll 32 fails to rotate, sensor 33 will signal a control (not shown) to divert tape 10 away from the track that leads it across the width of the travelling web of paper to the vicinity of the new wind up roll. The operator is signaled with that information so that he may abort the faulty tape 10 and begin a new cycle to apply adhesive to tape 10 and send it across the web to the new wind up roll. It is emphasized that adhesive detector roll 32 and rotation detector 33 are not part of this invention. The present invention includes all that is within the bounds of container 13 and including transfer roller 16 which has a small portion of its perimeter extending outwardly of container 13 so as to contact the surface to which adhesive is to be applied, in this case the lower surface of tape 10.

Figure 2:
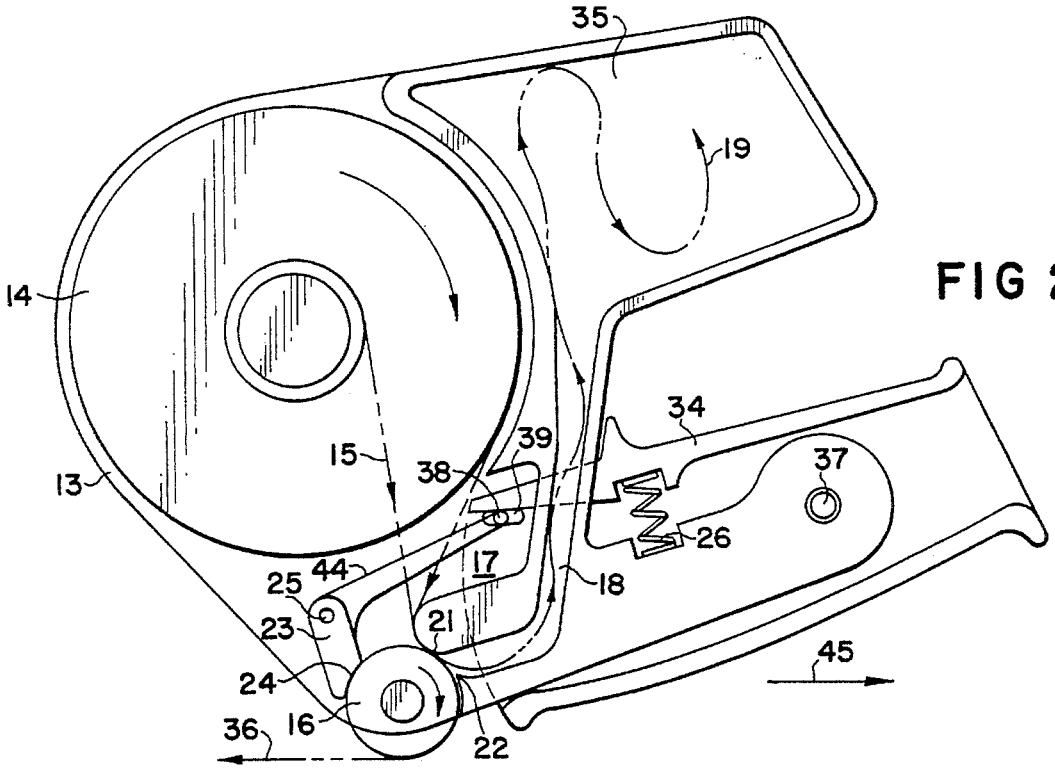
FIG. 2 is a front elevational view of a first embodiment of the device of this invention in the form of a hand held applicator for applying adhesive to a surface.
Figure 3:
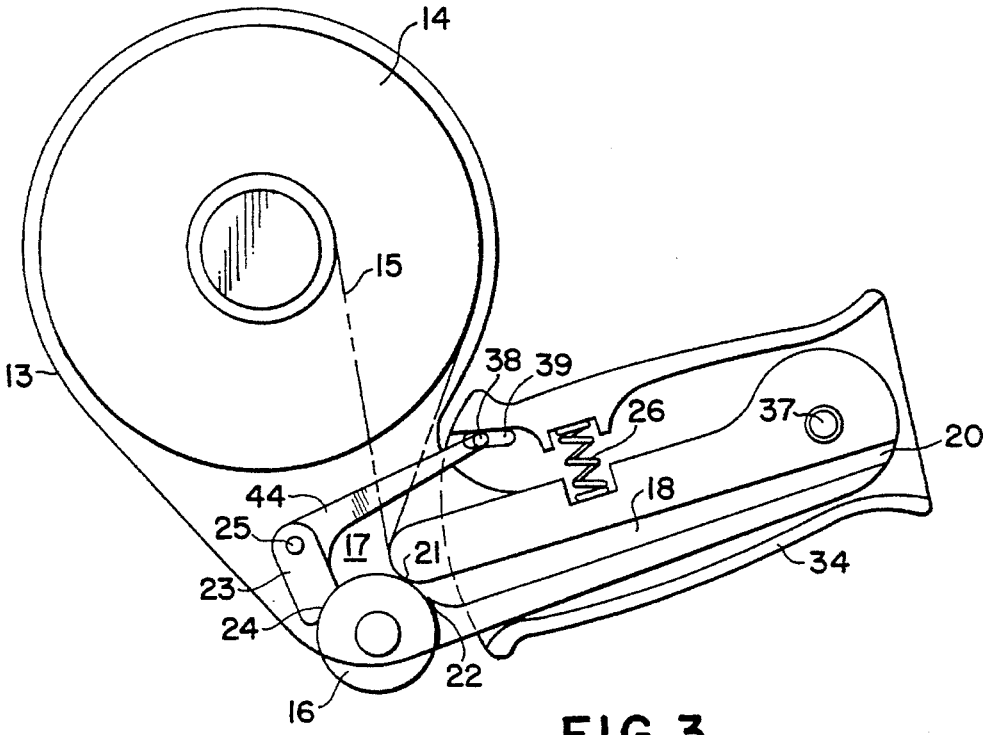
FIG. 3 is a front elevational view of a second embodiment of the device of this invention when it is not in use applying adhesive to a surface.
Figure 4:
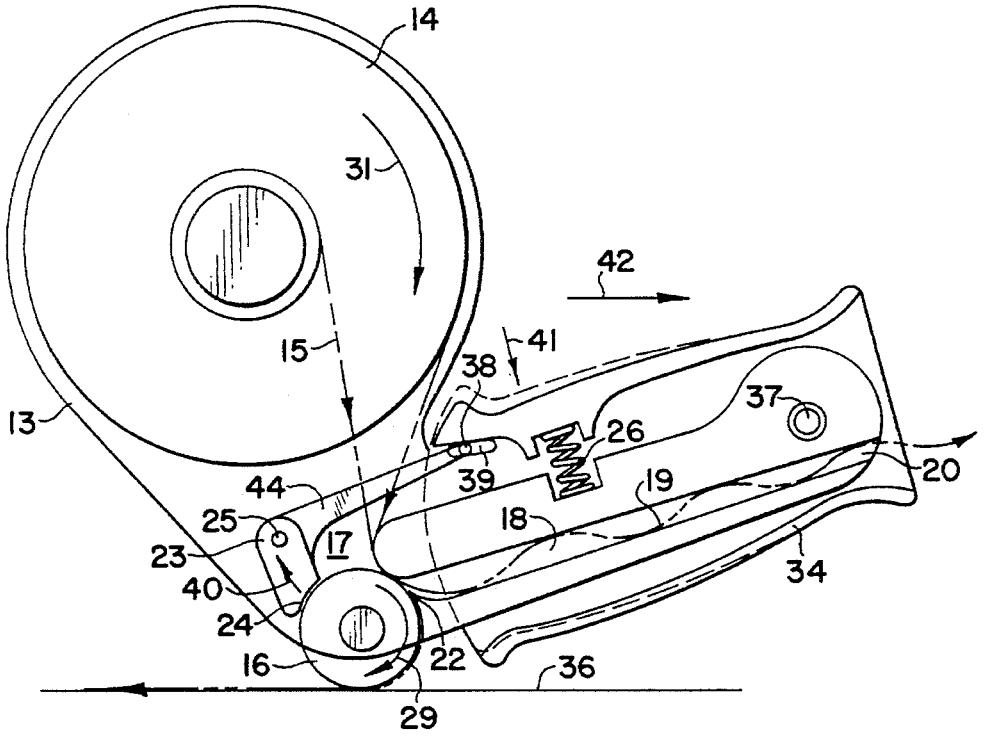
FIG. 4 is another view of the device of FIG. 3 when it is in use applying adhesive to a surface.

FIGS. 2–4 depict an adhesive dispenser having all of the components and features of the device of FIG. 1 except that the device of FIGS. 2–4 is designed to be used manually to apply adhesive to a surface rather than be attached to a machine to do the same. The device of FIG. 2 is an embodiment that includes a collection space 35 to collect the backing tape stripped from its adhesive layer. In FIGS. 3–4 the backing layer is discharged to the outside of the device, as in FIG. 1, with no specific receptacle to collect the backing tape.

In FIG. 2 the supply roll 14 of composite tape 15 leads the tape to transfer roll 16 which is pressed downwardly against surface 36 and pulled from left to right in the direction of arrow 45 to deposit a strip of adhesive thereon. The operator's hand fits around pistol grip 34 so as to direct the movement of the device. This embodiment has a brake member 23 with a friction face 24 and a pivot 25. Arm 44 of brake member 23 is fashioned with a pin 38 that is engaged in slot 39 in the structure of handle grip 34. Grip 34 is pivoted around pin 37. When the operator with his hand around grip 34 pushes downward to apply force to press transfer roller 16 against surface. 36 it causes grip 34 to pivot about pin 37 which presses downwardly on slot 39 and pin 38. This movement causes friction face 24 to move away from transfer roller 16 and releases it to rotate. In the view as shown in FIG. 2 the device is moved in the direction of arrow 45 to lay down a strip of adhesive on surface 36, which may be any type of reasonably smooth surface, and could, for example, be a cutting tape 10, as described above with respect to FIG. 1. It may be seen that channel 18 leads to space 35 which receives backing layer 19 after being deflected by sharp edge 22. Space 35 could be periodically emptied by constructing an access door in one of the walls of space 35 or be emptied by opening cartridge 13 to remove tape 19 and also to replace a spent roll 14 with a new roll 14 of composite tape 15.

The embodiments in FIGS. 3 and 4 are similar to that of FIG. 2 in all respects except that channel 18 leads to exit port 20 which directs tape 19 to the outside of device 13 rather than to a specific receptacle for tape 19. Arrow 41 shows the direction of movement to cause handle grip 34 to release brake member 23. Arrow 42 shows the direction of movement of device 13 to lay down a strip of adhesive on surface 36. Arrow 40 shows the movement of friction face 23 when the braking action is released by pressing handle grip 34 down in the direction of arrow 41. FIG. 3 shows the positions of all components when device 13 is at rest. FIG. 4 shows those same positions in dotted lines, and in addition shows the positions in solid lines when the device 13 is handled and operated to lay down a strip of adhesive on surface 36.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A device substantially enclosed in a portable container for applying a strip of double-sided pressure sensitive tape to a receiving surface, said device including a rotatable supply roll of composite tape consisting of a layer of double-sided pressure sensitive adhesive adhered to a strippable backing layer, a rotatable transfer roller including a cylindrical outer surface having a portion exposed outwardly of said container, said transfer roller receiving said adhesive layer and applying same to a receiving surface, said transfer roller being the sole driving means for movement of said composite tape and said backing layer being freely movable upon its release from said double-sided pressure sensitive tape, said outer surface having poor affinity for adhering to said adhesive tape, a stationary tapering nose having a rounded tip with a return bend surface spaced apart from the surface of said transfer roller generally the thickness of said double-sided pressure sensitive tape, a first channel leading from said supply roll to said tip for said composite tape, a second channel leading from said tip to a disposal site for said backing layer which is freely movable after being released from said double-sided pressure sensitive tape, a brake member normally bearing against said transfer roller for inhibiting rotation thereof except during application of said strip to a receiving surface, and selective means for releasing said brake member.

2. The device of claim 1 wherein said second channel terminates in an exit port leading to outside said container.

3. The device of claim 1 wherein said second channel leads to an interior space in said container adapted to receive said backing tape.

4. The device of claim 1 wherein said selective means for releasing said brake member includes a movable device separate from said container and adapted to selectively bear against said brake member.

5. The device of claim 1 wherein said portable container is a replaceable component in an apparatus for spooling continuously travelling webs of paper, intermittently cutting said web with a cutting tape, and transferring said cut web to an empty spool.

6. The device of claim 1 wherein said portable container is a cassette with built-in structure for rotatably supporting said supply roll, and for providing a pivot for said brake member.

7. The device of claim 1 wherein said brake member includes a pivotable lever arm including a friction face that is pivotable to bear against or be spaced apart from said cylindrical outer surface.

8. The device of claim 1 wherein said cylindrical outer surface is a silicone rubber.

9. The device of claim 1 which additionally includes a sharp edge positioned transversely to the movement of said double-sided adhesive tape and positioned downstream from said nose tip and very close to the double-sided adhesive temporarily adhering to said transfer roller, said sharp edge being adapted to assure separation of said backing layer from said double-sided adhesive layer.

10. A device substantially completely enclosed in a cassette container and adapted to deliver and to apply to a receiving surface a strip of pressure-sensitive adhesive, said device including a freely rotatable roll of a composite tape consisting of a continuous layer of double-sided adhesive adhering to a continuous strip of backing layer readily strippable from said adhesive; a rotatable transfer roll being the sole driving means for movement of said composite tape and adapted to receive said layer of adhesive from said composite tape and apply it to a receiving surface as the transfer roll rotates while releasing said backing layer to free movement, a portion of said transfer roll extending outwardly from said cassette container; a first channel for guiding said composite tape from said supply roll to said transfer roll; a second channel for guiding said backing layer from said transfer roll to disposal zone for said backing layer, a return bend rounded surface joining said first channel to said second channel at a position closely adjacent said transfer roll, and a frictional braking means for preventing rotation of said transfer roll except during application of said strip to a receiving surface.

11. The device of claim 10 further comprising a receiving surface, said receiving surface being one surface of an elongated narrow paper cutting tape employed in the paper industry in transferring the wind up of a continuous web of paper from one wind up roll to another.

12. The device of claim 10 wherein said braking means includes a spring biased pivotable lever having said frictional face as a component thereof and which includes movable member adapted to overcome said spring bias and move said frictional face away from contact with said transfer roll.

13. The device of claim 12 wherein said movable member is a hand controlled pivotable lever.

14. The device of claim 12 wherein said movable member is a plunger separate from said cassette container and adapted to automatically apply a force contrary to said spring bias when it is desired to apply said adhesive layer to said receiving surface.

15. The device of claim 10 which additionally comprises a doctor knife edge positioned closely adjacent to said return bend surface and positioned to assure stripping of said backing layer from said composite tape temporarily adhered to said transfer roll.

16. The device of claim 10 wherein said transfer roll includes a cylindrical surface of material having a positive but poor adherence to said layer of pressure-sensitive adhesive.

17. A device substantially enclosed in a portable container for applying a strip of double-sided pressure sensitive adhesive to a receiving surface, said device including a rotatable supply roll of composite tape consisting of a strip of double-sided pressure sensitive adhesive adhered to a strippable backing layer, a rotatable transfer roller having a cylindrical outer surface adapted to receive said double-sided pressure sensitive adhesive strip and apply it to a receiving surface, said outer surface of said transfer roller having poor affinity for adhering to said adhesive of said double-sided strip, a stationary tapering nose having a rounded tip with a return bend surface spaced apart from the surface of said transfer roller substantially the thickness of said double-sided adhesive strip, a first channel leading from said supply roll to said tip and a second channel leading from said tip to a disposal site for said backing layer, a sharp edge positioned transversely to the movement of said double-sided adhesive strip and positioned downstream from said nose tip and juxtaposed to said double-sided adhesive strip temporarily adhering to said transfer roller, said sharp edge assuring separation of said backing layer from said double-sided adhesive strip upstream from said sharp edge, said sharp edge passing said double-sided adhesive strip attached to said transfer roller while preventing said backing layer from passing between said sharp edge and said double sided adhesive strip attached to said transfer roller.

18. The device of claim 17 further including brake means for inhibiting movement of said strip of double-sided adhesive, and selective means for releasing said brake means to permit movement of said double-sided strip except during application of said strip to a receiving surface.

19. The device of claim 18 wherein said brake means includes a pivotable lever arm having a friction face that is pivotable to selectively bear against and spaced apart from said cylindrical outer surface.

20. The device of claim 19 wherein said brake means includes a spring biasing said friction face into engagement with said cylindrical outer surface, said cylindrical outer surface being a silicone rubber.

* * * * *